US009112254B2

(12) United States Patent
Cisco et al.

(10) Patent No.: US 9,112,254 B2
(45) Date of Patent: Aug. 18, 2015

(54) SWITCHED PATH TRANSMISSION LINE PHASE SHIFTER INCLUDING AN OFF-SET TWIN LEAD LINE ARRANGEMENT

(71) Applicant: RAYTHEON COMPANY, Waltham, MA (US)

(72) Inventors: Terry C. Cisco, Glendale, CA (US); Clinton O. Holter, Long Beach, CA (US)

(73) Assignee: RAYTHEON COMPANY, Waltham, MA (US)

( * ) Notice: Subject to any disclaimer, the term of this patent is extended or adjusted under 35 U.S.C. 154(b) by 151 days.

(21) Appl. No.: 13/738,140

(22) Filed: Jan. 10, 2013

(65) Prior Publication Data

US 2014/0191822 A1 Jul. 10, 2014

(51) Int. Cl.

| | |
|---|---|
| ***H01P 1/18*** | (2006.01) |
| ***H01P 11/00*** | (2006.01) |
| ***H01P 5/02*** | (2006.01) |

(52) U.S. Cl.

CPC *H01P 1/183* (2013.01); *H01P 1/18* (2013.01); *H01P 1/184* (2013.01); *H01P 5/028* (2013.01); *H01P 11/00* (2013.01); *Y10T 29/49016* (2015.01)

(58) Field of Classification Search

CPC ..... H01P 1/184; H01P 5/08; H01P 1/18
USPC ..... 333/161, 164
See application file for complete search history.

(56) References Cited

U.S. PATENT DOCUMENTS

| | | | | |
|---|---|---|---|---|
| 5,583,468 | A * | 12/1996 | Kielmeyer et al. | 333/33 |
| 6,967,282 | B2 | 11/2005 | Tonomura et al. | |
| 7,053,732 | B2 * | 5/2006 | Zhou | 333/156 |
| 8,009,114 | B2 * | 8/2011 | Hauhe et al. | 343/754 |
| 8,283,991 | B1 | 10/2012 | Essenwanger | |
| 2006/0220760 | A1 | 10/2006 | Floyd et al. | |
| 2011/0006859 | A1 | 1/2011 | Cisco | |
| 2011/0187453 | A1 | 8/2011 | Deckman et al. | |
| 2012/0032752 | A1 | 2/2012 | Song et al. | |

FOREIGN PATENT DOCUMENTS

| | | | |
|---|---|---|---|
| EP | 1798806 | A1 | 6/2007 |
| KR | 20050030022 | A | 3/2005 |

OTHER PUBLICATIONS

Eldek, A., Wideband 180° Phase Shifter Using Microstrip-CPW-Microstrip Transition, Progress in Electromagnetics Research B, vol. 2, 177-187, 2008.

Microwave Phase Shifter: Application Notes, Herley, Companies; Downloaded Online via http://www.herley.com/index.cfm?act=app_notes&notes=iqv_phaseshift, 2 pages, [Aug. 15, 2011].

PIN diode 180 degree phase shifter, Microwave Encyclopedia, Microwaves101.com; Downloaded Online via http://www.microwaves101.com/encyclopedia/phaseshifters_PIN_diode_180.cfm, 11 pages, [Aug. 15, 2011].

* cited by examiner

*Primary Examiner* — Benny Lee
(74) *Attorney, Agent, or Firm* — Burns & Levinson LLP; Joseph M. Maraia

(57) ABSTRACT

Embodiments disclosed include transmission line phase shifters and methods for fabricating transmission line phase shifters that switch signal and ground conductors to reverse electromagnetic fields in a transmission line structure.

6 Claims, 4 Drawing Sheets

Note: 1. All cross sections are in the transverse plane – perpendicular to the direction of signal propagation
2 Transition 2 is identical to Transition 1 reflected
3.Transition 3 is identical to Transition 1 rotated 180 degrees
4 The Single Pole Double Throw (SPDT) Switch in one embodiment is a G-CPW & FET based design Note: 1. All cross sections are in the transverse plane – perpendicular to the direction of signal propagation
2 Transition 2 is identical to Transition 1 reflected
3. Transition 3 is identical to Transition 1 rotated 180 degrees
4 The Single Pole Double Throw (SPDT) Switch in one embodiment is a G-CPW & FET based design

SWITCHED PATH TRANSMISSION LINE PHASE SHIFTER INCLUDING AN OFF-SET TWIN LEAD LINE ARRANGEMENT

FIELD OF THE INVENTION

The disclosure relates to phase shifters and transmission line phase shifters and methods for fabricating the same.

BACKGROUND

Microwave and other electronic signal processing equipment such as radars and active electronically scanned array (AESA) systems, also known as active phased array radars, require modifications or changes to the signals flowing through them. Frequently this requires the signal to be shifted in phase to be 180 degrees out of phase with the original signal phase. Current solutions are expensive, do not perform well, are too large to fit the available space, and have limited operating bandwidth. A need therefore exists for improved phase shifters.

SUMMARY

Phase shifting techniques are used to make electronic signals travelling through a transmission line arrive at a destination at a predetermined time. Approaches described herein achieve this effect without requiring an increase in the transmission line length which typically requires additional layout or packaging space to accommodate. In radar systems, the approaches described can be used to control, for example, beam steering in AESA systems. AESA systems can be used to identify properties (e.g., altitude, velocity, direction, physical geometry, or range) of objects such as aircraft, ground vehicles, or ground or building structures.

One approach to a transmission line phase shifter that switches signal and ground conductors to reverse electromagnetic fields in a transmission line structure includes a first grounded coplanar transmission line having a first end and a second end. The phase shifter also includes a first microstrip transmission line having a first end and a second end, wherein the first end of the first microstrip transmission line is coupled to the second end of the first grounded coplanar transmission line. The phase shifter also includes a twin lead line having a first end, a second end, a ground conductor and a signal conductor, wherein the first end of the twin lead line is coupled to the second end of the first microstrip transmission line. The phase shifter also includes a second microstrip transmission line having a first end and a second end, wherein the first end of the second microstrip transmission line is coupled to the second end of the twin lead line. The phase shifter also includes a second grounded coplanar transmission line having a first end and a second end, wherein the first end of the second grounded coplanar transmission line is coupled to the second end of the second microstrip transmission line.

In some embodiments, the first and second grounded coplanar transmission lines, the first and second microstrip transmission lines, and the twin lead line are integrated into an integrated circuit device. In some embodiments, the phase shifter includes switching transistors integrated into the integrated circuit device to select between a reference arm and phase delay arm of the transmission line phase shifter.

In some embodiments, constructing switching transistors into the integrated circuit device reduces parasitic effects associated with the transmission line phase shifter. In some embodiments, the grounded coplanar transmission lines, microstrip transmission line, and twin lead line are created using a monolithic microwave integrated circuit (MMIC) structure.

Another aspect includes a method for fabricating a transmission line phase shifter that switches signal and ground conductors to reverse electromagnetic fields in a transmission line structure. The method includes coupling an end of a first grounded coplanar transmission line to a first end of a first microstrip transmission line and coupling a first end of a twin lead line to a second end of the first microstrip transmission line, wherein the twin lead line includes a second end, a ground conductor and a signal conductor. The method includes coupling a first end of a second microstrip transmission line to the second end of the twin lead line and coupling a first end of a second grounded coplanar transmission line to the second end of the second microstrip transmission line.

In some embodiments, the method includes integrating the first and second grounded coplanar transmission lines, the first and second microstrip transmission lines, and the twin lead line into an integrated circuit device. In some embodiments, the method includes integrating switching transistors into the integrated circuit device to select between a reference arm and phase delay arm of the transmission line phase shifter.

In some embodiments, integrating switching transistors into the integrated circuit device reduces parasitic effects associated with the transmission line phase shifter. In some embodiments, the method includes fabricating the grounded coplanar transmission lines, microstrip transmission line, and twin lead line using a monolithic microwave integrated circuit (MMIC) structure.

The phase shifter methods and systems described herein (hereinafter "technology") can provide one or more of the following advantages. One advantage of the technology is that it creates a 180 degree phase shift in a transmission line by taking advantage of multilayer fabrication techniques (in, for example, monolithic microwave integrated circuit (MMIC) and integrated circuit (IC) semiconductor devices) to create a compact, wide bandwidth transmission line phase shifter. Another advantage is that the fabrication techniques enable direct integration of switching transistors into the circuitry, thereby minimizing or compensating for parasitic effects. The technology provides for distributed transmission line transformation, which maximizes operating frequency bandwidth of the phase shifter.

Other aspects and advantages of the current invention will become apparent from the following detailed description, taken in conjunction with the accompanying drawings, illustrating the principles of the invention by way of example only.

BRIEF DESCRIPTION OF THE DRAWINGS

The foregoing features of various embodiments of the invention will be more readily understood by reference to the following detailed descriptions in the accompanying drawings.

DETAILED DESCRIPTION OF ILLUSTRATIVE EMBODIMENTS

The technology described herein takes advantage of the multiple metal and dielectric layers available in semiconductor processing techniques, such as gallium arsenide, gallium nitride, silicon/silicon-germanium BiCMOS (combination of bipolar junction transistor technology and Complementary metal-oxide-semiconductor technology, to introduce a reversal of electromagnetic fields in a transmission line structure. The reversal provides a 180 degree phase shift that is low loss and effectively independent of frequency. The structures produced are also compact and inexpensive.

Figure 1:
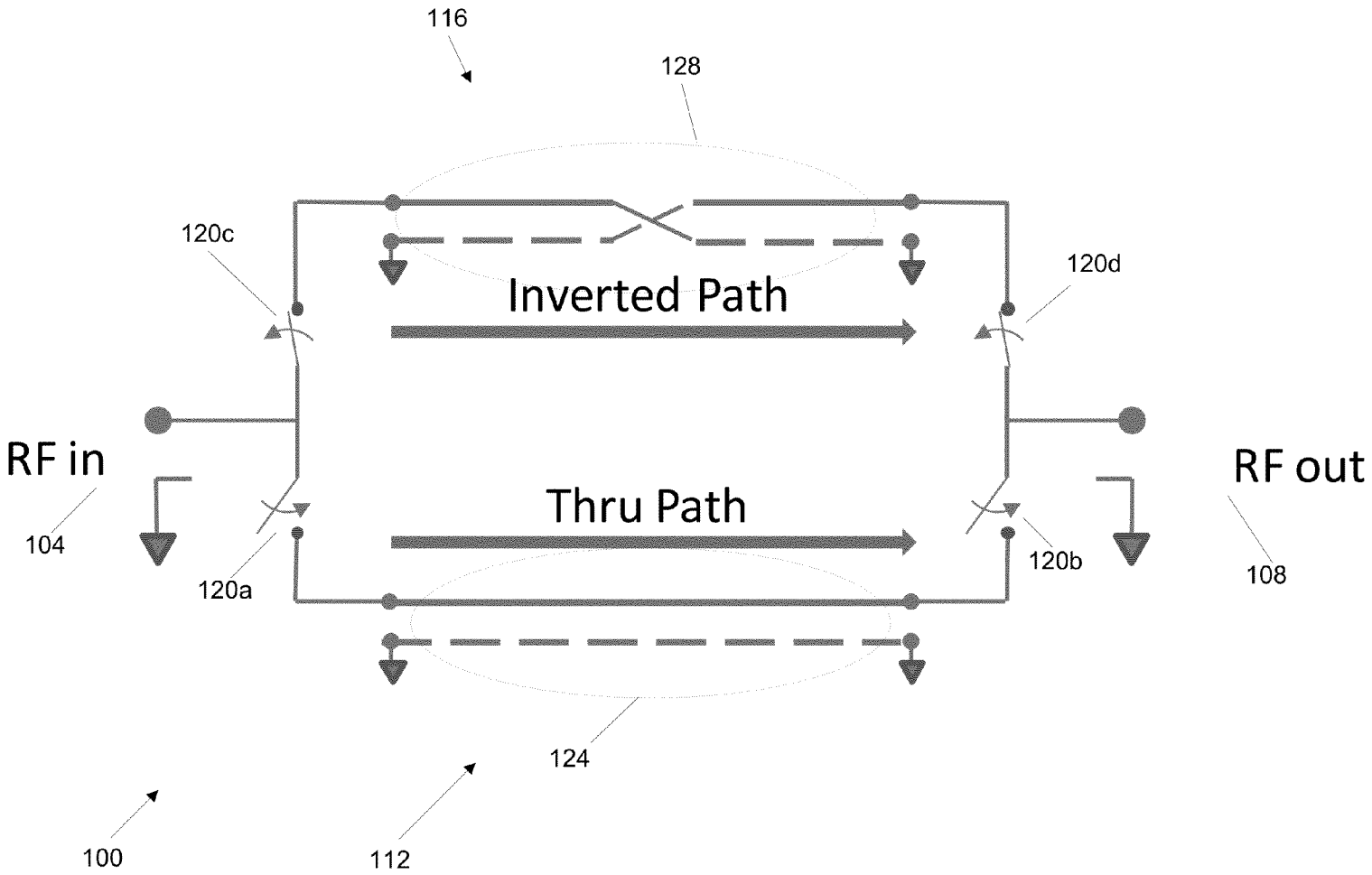
FIG. 1 is a schematic block diagram of a model for a transmission line phase shifter, according to an illustrative embodiment.

FIG. 1 is schematic block diagram of a model for a transmission line phase shifter 100, according to an illustrative embodiment. The transmission line phase shifter 100 receives a radar frequency (RF) signal at an input (RFin) 104 of the phase shifter 100. The RF signal can travel along two different paths 112 and 116 depending on the operating states of four series switches 120*a*, 120*b*, 120*c*, and 120*d*. When the two switches 120*a*, 120*b* are active, the RF signal travels along the activated path 112. When switches 120*c* and 120*d* are active, the RF signal is able to travel along path 116. Path 112 is a thru path that includes a thru line 124 that passes the RF signal through from the input 104 to the RF signal output (RFout) 108. Path 116 is an inverted path that includes a line 128 that reverses the electromagnetic field in the signals passing through the transmission line phase shifter 100. Reversing the electromagnetic field creates a 180 degree phase shift. Details of exemplary embodiments are described further below.

Figure 2:
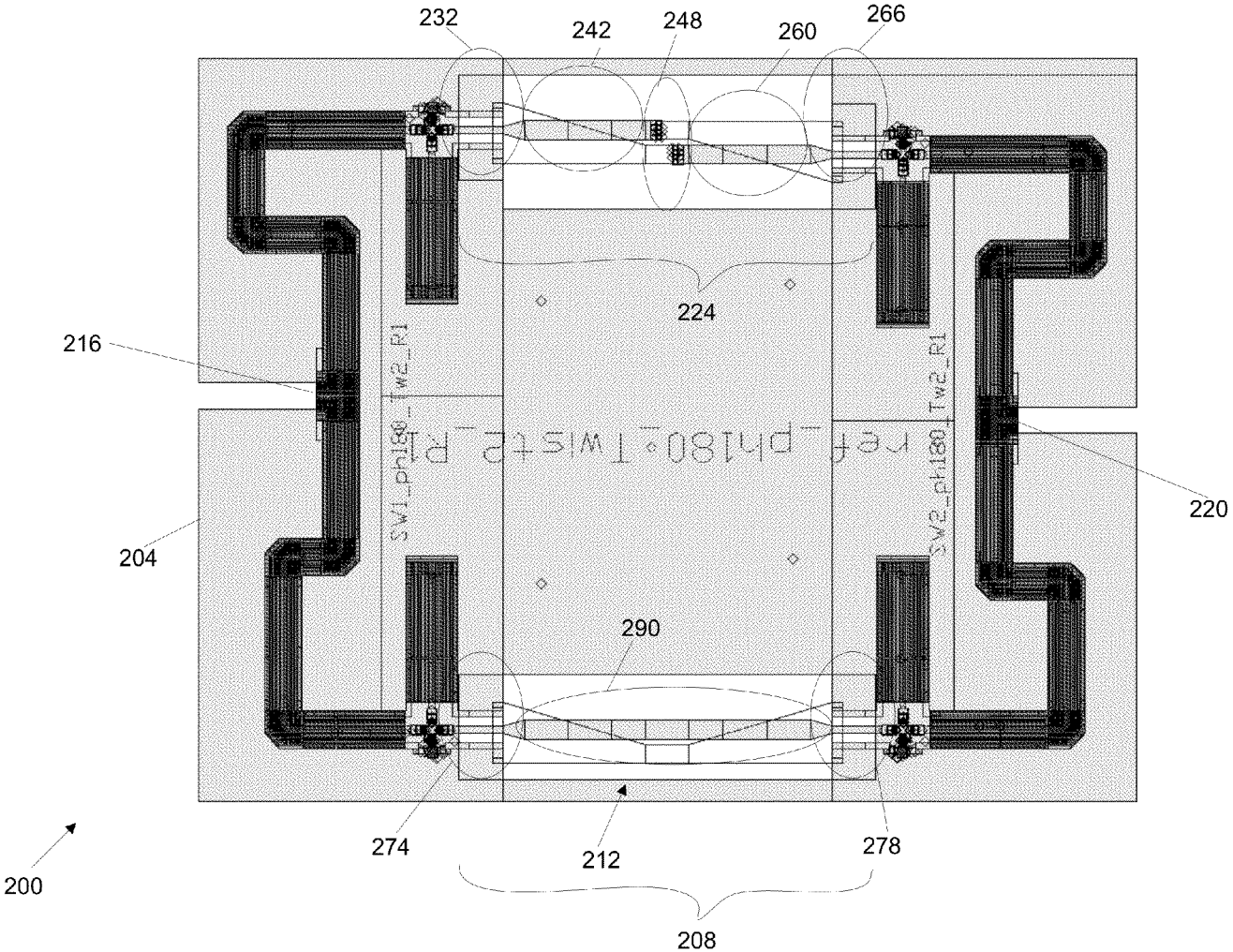
FIG. 2 is a schematic illustration of a plan view of a transmission line phase shifter, according to an illustrative embodiment.

FIG. 2 is a schematic illustration of a plan view of a transmission line phase shifter 200, according to an illustrative embodiment. The phase shifter 200 is constructed using a monolithic microwave integrated circuit (MMIC) structure 204. Devices constructed using a MMIC structure are integrated circuit devices that operate at typical microwave frequencies (e.g., in the range of 0.3 GHz to 300 GHZ). Microwave devices are typically designed such that the input and output characteristics are matched, having an impedance of 50 ohms. Because the functionality of the device is captured in an integrated circuit package, the devices tend to be relatively compact (e.g., in this embodiment, having an area with respect to the plan view of FIG. 2 of less than 0.5 $mm^2$).

The phase shifter 200 includes at least three different types of electrical lines to create a 180 degree phase shift in RF signals input to the phase shifter 200: grounded coplanar transmission lines, twin lead lines, and microstrip transmission lines (described below with respect to shifter 300 in FIG. 3).

Figure 3:
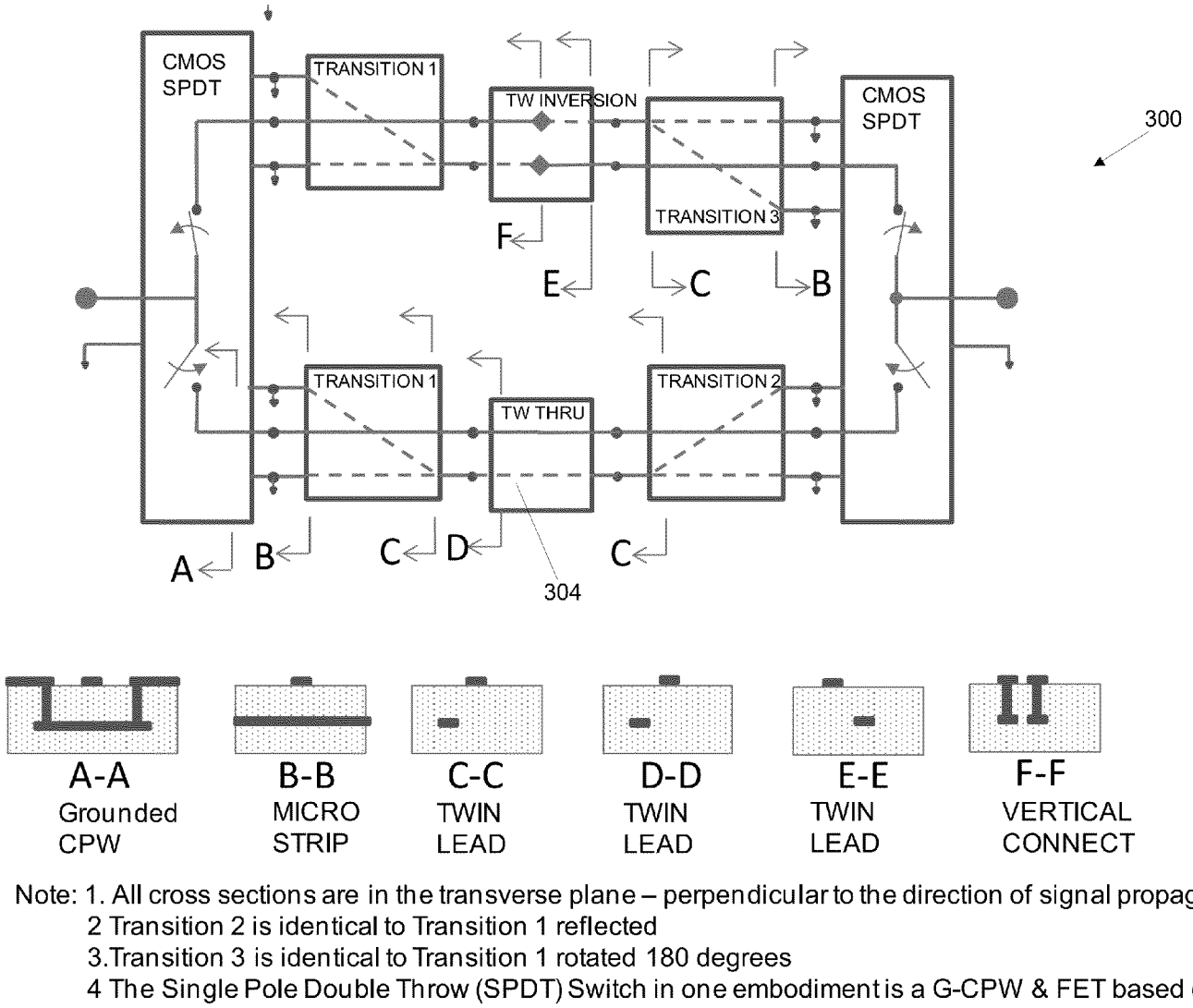
FIG. 3 is a schematic illustration of a transmission line phase shifter and cross sections of the phase shifter, according to an illustrative embodiment.

Section A-A of FIG. 3 is a cross section of a grounded coplanar transmission line. Section B-B is a cross section of a microstrip transmission line. Section C-C is a cross section of a first portion of a twin lead line. Section D-D is a cross section of a second portion of a twin lead line. Section E-E is a cross section of a third portion of a twin lead line. Section F-F is a cross section of a vertical connect in shifter 300. The cross sections are illustrated in the transverse plane of the shifter, perpendicular to the direction of signal propagation. Transition 1 is a transition from a microstrip transmission line to a twin lead line. Transition 2 is a transition from the twin lead line to a microstrip transmission line, and is considered to be a reflection of transition 1. Transition 3 is identical to transition 2 but rotated by 180 degrees due to the twin lead line inversion (TW Inversion). Portion 304 is a thru path for a twin lead line (TW Thru). The two CMOS SPDT modules denote single-pole-double-throw switches constructed in CMOS technology. In one embodiment the CMOS SPDT are (G-CPW and FET-based designs Referring to FIG. 2, the phase shifter 200 includes two paths 208 and 224. Path 208 is a series line 212 that passes the RF signal through from the input 216 to the RF signal output 220. Path 224 is a line that reverses the electromagnetic field in the signals passing through the transmission line phase shifter 200 to create a 180 degree phase shift in RF signals relative to the signals passed through path 208 of the phase shifter 200. Signal leads and ground leads of a line are connected to respective signal leads and grounds leads of adjacent lines except where described below regarding the twin lead line. Path 224 begins with a first grounded coplanar transmission line 232 having a first end and a second end. The first end is coupled to the RF input 216 and, the phase shifter 200 includes a series switch between the RF input 216 and the first end of the first grounded coplanar transmission line 232.

The second end of the grounded coplanar transmission line 232 is coupled to the first end of a first microstrip transmission line 242. The second end of the microstrip transmission line 242 is coupled to a first end of a twin lead line 248. The twin lead line 248 has a ground conductor and a signal conductor. The signal conductor of the first end of the twin lead line 248 is coupled to the signal conductor of the first microstrip transmission line 242. The ground conductor of the first end of the twin lead line 248 is coupled to the ground conductor of the microstrip transmission line 242.

The phase shifter 200 also includes a second microstrip transmission line 260. The first end of the microstrip transmission line 260 is coupled to the second end of the twin lead line 248. The signal conductor of the second end of the twin lead line 248 is coupled to the ground conductor of the microstrip transmission line 260. The ground conductor of the second end of the twin lead line 248 is coupled to the signal conductor of the microstrip transmission line 260. By coupling the signal conductor of the microstrip transmission line 242 to a ground conductor of the microstrip transmission line 260 (and the ground conductor of the microstrip transmission line 242 to the signal conductor of the microstrip transmission line 260), the 180 degree phase shift is introduced in RF signals relative to the signals passed through path 208 of the phase shifter 200 by the twin lead line inversion (e.g., the twin lead line inversion of FIG. 3 (TW Inversion)). The phase shifter 200 also includes a second grounded coplanar transmission line 266. The first end of the grounded coplanar transmission line 266 is coupled to the second end of the microstrip transmission line 260. The second end of the grounded coplanar transmission line 266 is coupled to the RF signal output 220. In order to create a well matched transition from the grounded coplanar transmission line to twin lead line, it was necessary to use matched transitions from the grounded coplanar transmission line, to microstrip transmission line, and to twin lead line.

In order to maintain phase and amplitude balance in the two paths (208 & 224), path 208 is constructed similarly to path 224, but does not include the twin lead inversion. Path 208 is a thru line (e.g., thru line 124 of FIG. 1) that begins with a first grounded coplanar transmission line 274 having a first end and a second end. The first end is coupled to the RF input 216. The second end of the grounded coplanar transmission line 274 is coupled to the first end of a microstrip transmission line 290. The second end of the microstrip transmission line 290 is coupled to the first end of the grounded coplanar transmission line 278. The second end of the grounded coplanar transmission line 278 is coupled to the RF signal output 220.

Figure 4:
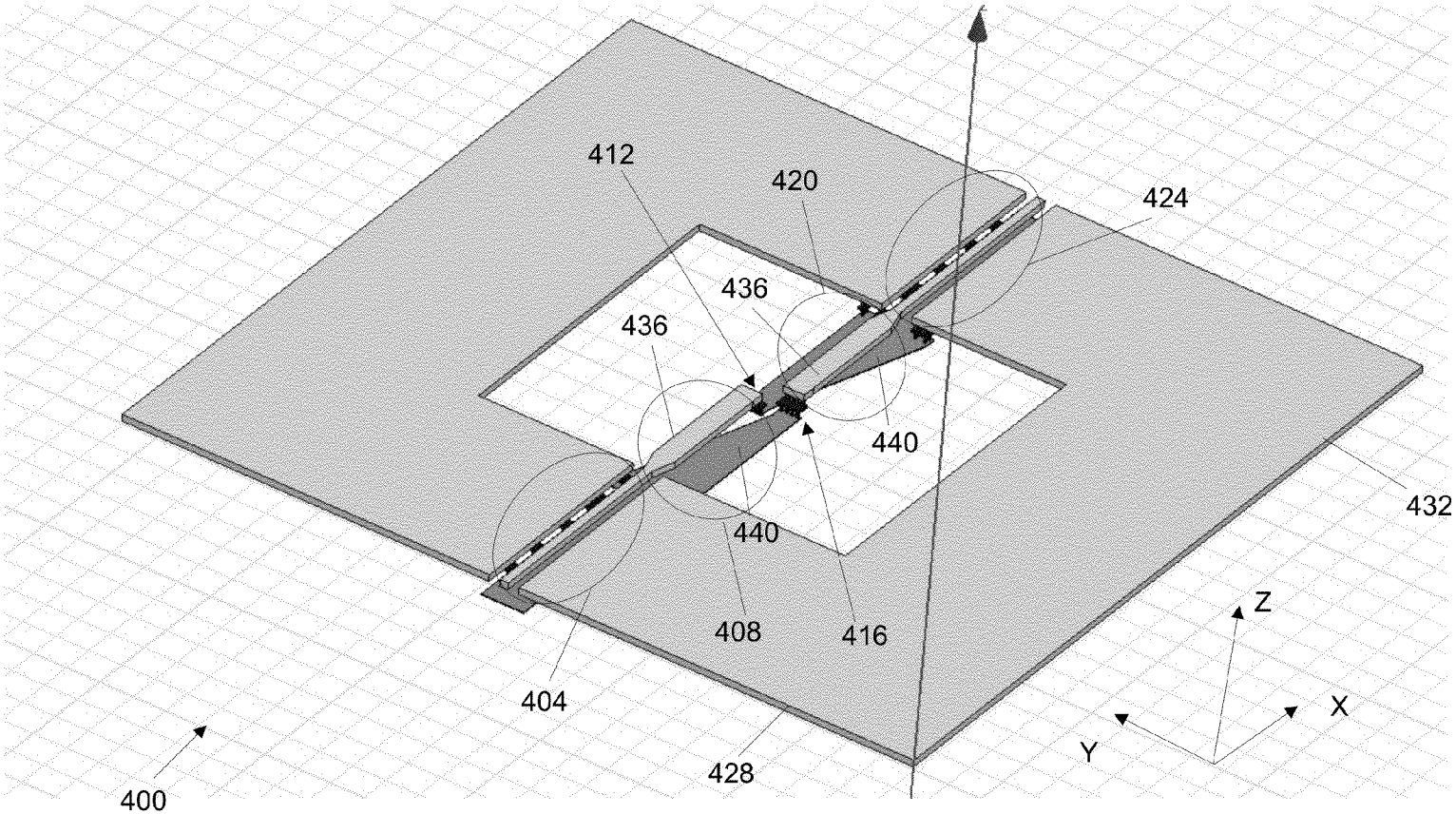
FIG. 4 is a schematic illustration of a perspective view of a portion of a transmission line phase shifter, according to an illustrative embodiment.

FIG. 4 is a schematic illustration of a perspective view of a portion 400 of a transmission line phase shifter (e.g., the portion corresponding to path 224 of FIG. 2). The portion 400 of the phase shifter reverses the electromagnetic field in the signals passing through the transmission line phase shifter 200 of FIG. 2 to create a 180 degree phase shift in RF signals input to the phase shifter 200 of FIG. 2, relative to the signals passed through path 208 of FIG. 2. This illustration more clearly depicts the three-dimensional layout of one embodiment of an exemplary phase shifter. It includes, two grounded coplanar transmission lines 404 and 424, two lines 408 and 420 (e.g., Transition 1 of FIG. 3) which consist of a matched grounded coplanar to microstrip transition, a short section of microstrip transmission line, and a matched microstrip to offset twin lead transition 436, and a twin lead inversion which consists of two vertical transitions 412 and 416. The two lines 408, 420 include upper conductors 436 and lower conductors 440. The grounded coplanar transmission lines 404 and 424 are shown with ground plane 428, 432. And X-Y-Z reference is shown for perspective of the drawing. The combination of the three different types of lines (i.e., grounded coplanar transmission lines, microstrip transmission lines, and twin lead lines) configured in the three-dimensional structure provided using the MMIC structure allows for the phase shifter to be a compact and highly integrated, single device.

One skilled in the art will realize the invention may be embodied in other specific forms without departing from the spirit or essential characteristics thereof. The foregoing embodiments are therefore to be considered in all respects illustrative rather than limiting of the invention described herein. Scope of the invention is thus indicated by the appended claims, rather than by the foregoing description, and all changes that come within the meaning and range of equivalency of the claims are therefore intended to be embraced therein.

The invention claimed is:

1. A transmission line phase shifter that switches signal and ground conductors to reverse electromagnetic fields in a transmission line structure, comprising:

a first grounded coplanar transmission line having a first end and a second end;

a first microstrip to offset twin lead transition transmission line having a first end with a microstrip cross section and a second end with an offset twin lead cross section, wherein the first end of the first microstrip to offset twin lead transition transmission line is coupled to the second end of the first grounded coplanar transmission line;

a first offset twin lead line having a first end, a second end, a ground conductor, a signal conductor and a separate vertical transition in each of the ground conductor and the signal conductor reversing their relative vertical position, wherein the first end of the first offset twin lead line is coupled to the second end of the first microstrip transmission line;

a second microstrip to offset twin lead transition transmission line having a first end with an offset twin lead cross section and a second end with a microstrip cross section, wherein the first end of the second microstrip to offset twin lead transition transmission line is coupled to the second end of the twin lead line; and a second grounded coplanar transmission line having a first end and a second end, wherein the first end of the second grounded coplanar transmission line is coupled to the second end of the second microstrip to offset twin lead transition transmission line.

2. The transmission line phase shifter of claim 1, wherein the first and second grounded coplanar transmission lines, the first and second microstrip to offset twin lead transition transmission lines, and the first offset twin lead line are constructed in an integrated circuit device.

3. The transmission line phase shifter of claim 2, comprising switching transistors constructed in the integrated circuit device to select between a reference arm and phase delay arm of the transmission line phase shifter.

4. The transmission line phase shifter of claim 1, wherein the first and second grounded coplanar transmission lines, the first and second microstrip to offset twin lead transition transmission lines, and the first offset twin lead line are created using a monolithic microwave integrated circuit (MMIC) structure.

5. The transmission line phase shifter of claim 1, further comprising:

an input coupled to the first end of the first grounded coplanar transmission line;

an output coupled to the second end of the second grounded co-planar transmission line; and a reference path coupled to the input and the output and including a third grounded coplanar transmission line coupled to the input, a third microstrip to offset twin lead transition transmission line having a first end with a microstrip transmission line cross section coupled to the third grounded coplanar transmission line and a second end with a an offset twin lead cross section, a second offset twin lead line coupled to the second end of the third microstrip to offset twin lead transition transmission line, a fourth microstrip to offset twin lead transition transmission line having a first end with an offset twin lead cross section coupled to the second offset twin lead line and a second end with a microstrip cross section, and a fourth grounded coplanar transmission line coupled between the second end of the fourth microstrip to offset twin lead transition transmission line and the output.

6. The transmission line phase shifter of claim 5, further comprising separate integrated circuit transistors located in each grounded coplanar transmission line for selectively connecting each grounded coplanar transmission line.

* * * * *